US012624910B1

(12) United States Patent
Foltz et al.

(10) Patent No.: US 12,624,910 B1
(45) Date of Patent: May 12, 2026

(54) REDUCED WEAPON SYSTEM BLOWBACK

(71) Applicant: U.S. Government as Represented by the Secretary of the Army, Picatinny Arsenal, NJ (US)

(72) Inventors: Adam L. Foltz, Long Valley, NJ (US); Francis J. Battersby, Ringwood, NJ (US); Michael W. Brown, Long Valley, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 18/979,826

(22) Filed: Dec. 13, 2024

(51) Int. Cl.
*F41A 5/18* (2006.01)
*F41A 5/24* (2006.01)

(52) U.S. Cl.
CPC . *F41A 5/24* (2013.01); *F41A 5/18* (2013.01)

(58) Field of Classification Search
CPC ..... F41A 5/18; F41A 5/20; F41A 5/26
See application file for complete search history.

(56) References Cited

U.S. PATENT DOCUMENTS 9,038,525 B2 5/2015 Sullivan et al.
9,046,312 B2 6/2015 Dieckmann
9,766,027 B1 * 9/2017 Cavanaugh ..... F41A 5/24
10,215,514 B2 * 2/2019 Hochstrate ..... F41A 5/24
10,330,408 B2 6/2019 Rode et al.
2013/0047832 A1 * 2/2013 Hochstrate ..... F41A 5/26 89/191.01

OTHER PUBLICATIONS

Beardmore-Farquhar, Modern Firearms, https://modernfirearms.net/en/machineguns/great-britain-machineguns/beardmore-farquhar-eng/ Retrieved Dec. 11, 2024.

* cited by examiner

*Primary Examiner* — J. Woodrow Eldred
(74) *Attorney, Agent, or Firm* — David J. Torrente

(57) ABSTRACT

A reloading firearm featuring a mechanism to reduce the blowback of toxic propellant gasses towards the warfighter. The reloading assembly acts in plural segments to increase the firing chamber-closed dwell time, while limiting adverse impact to the overall nominal rate of fire. Greater dwell time corresponds with reduced exposure of the warfighter to propellant gasses. Moreover, increasing the dwell time without otherwise altering the firing cycle has the additional effect of delaying the breech opening after the cartridge is fired. This delay in breech opening permits gas pressure at the muzzle, which may be elevated and/or constrained by flash and/or sound suppression, to dissipate before the breech is opened. Accordingly, when the breech opens later in the firing cycle, there is a reduced pressure gradient across the combination of barrel and firing chamber, which reduces a driving force of propellant gasses towards the warfighter via the open breech.

18 Claims, 10 Drawing Sheets

-- PRIOR ART --

-- PRIOR ART --

-- PRIOR ART --

REDUCED WEAPON SYSTEM BLOWBACK

STATEMENT OF GOVERNMENT INTEREST

The inventions described herein may be manufactured, used and licensed by or for the United States Government.

BACKGROUND OF THE DISCLOSURE

Field of the Disclosure

The instant disclosure relates to the field of armaments and more particularly to a firearm that limits the exposure of a warfighter to toxic exhaust gasses from the weapon when the weapon Is used in connection with a noise and/or flash suppressor.

Brief Description of Related Art

The operation of a firearm expels a projectile from the muzzle of the weapon under the pressure of rapidly combusting and expanding propellant gasses. To illustrate one particular application, involving one particular type of firearm, consider the gas-operated reloading type. Referring to FIGS. 8A, 8B, and 8C, interchangeably as the context will readily admit, illustrated is a sequence of operation for a gas-piston type reloading weapon, generally 10. This type of firearm cycles the weapon using energy derived from propellant gasses 18 in the firing chamber 32 and barrel 14. A bleed port 12 is located along the barrel 14. As the fired projectile 16 proceeds through the barrel 14, it unmasks the bleed port 12, for example as shown in FIG. 8B. The propellant gasses 18 driving the projectile 16 are admitted via the bleed port 12 into a cylinder 20. The propellant gasses 18 act on a piston 22, driving it rearward on the weapon 10. The piston 22 is connected to the bolt carrier 24 by a rod 26, and the bolt carrier 24 is likewise displaced rearward.

The rearward motion of the bolt carrier 24 first unlocks the bolt 28, for example by rotating the bolt 28 through a cam action upon the bolt 28 by the bolt carrier 24. Continued rearward motion of the bolt carrier 24 together with the bolt 28 extracts the spent cartridge 30 from the firing chamber 32. Once clear of the firing chamber 32, the spent cartridge 30 is ejected through an ejection port 44. Continuing pressure of propellant gasses 18 and/or rearward inertia of the piston 22, rod 26, bolt carrier 24 and bolt 28 continues to move the bolt assembly rearwards to clear the space above the magazine 34.

In the position of FIG. 8C, the projectile 16 is beyond the muzzle 36 of the barrel 14, and simultaneously, the breech bolt 28 is open at the firing chamber 32, which vents the pressure of any residual propellant gasses 18 within the combined barrel 14, cylinder 20 and firing chamber 34 to atmosphere. The combined piston 22, rod 26, bolt carrier 24 and bolt 28 have moved to the rearward extent of their range of motion, which has the effect of compressing return spring 38. With the bolt 28 clear of the top of the magazine 34, a magazine spring (not shown) raises a new cartridge 40 to the top of the magazine 34.

The force of the compressed return spring 38 drives the bolt 28 and bolt carrier 24 forward. The bolt 28 strips the new cartridge 40 from the top of the magazine 34, and seats the new cartridge 40 in the firing chamber 32. The bolt carrier 24 locks the bolt 28 with the cartridge 40 in the firing chamber 32. The hammer and/or trigger sear will have also been reset by the rearward motion of the bolt 28 as well. The weapon 10 is now in battery and ready to fire again. While the trigger 42 remains depressed, the weapon 10 will fire another round automatically if in an automatic mode, or amid a burst in a burst-fire mode. If in a semi-automatic mode, the weapon 10 will fire another round by a subsequent pull of the trigger 42. The reloading cycle thereafter repeats with each round fired, until the magazine 34 is exhausted.

The propellant gasses 18 unavoidably include constituents which may be harmful to a warfighter. Among these, the products of combustion will include carbon monoxide (CO), ammonia ($NH_3$), and hydrogen cyanide (HCN). Even brief exposures to CO at elevated concentrations impairs the blood's capacity to transport oxygen. Exposure to ammonia ($NH_3$) gasses presents immediate and significant operational issues, by generating eye, nose and throat irritation. Short duration of exposure to HCN generates eye irritation, breathing difficulty, headache, nausea, and vomiting. Propellant gasses will also necessarily contain aerosolized metals, including Copper (Cu), Zinc (Zn), Bismuth (Bi), and Lead (Pb), each of which are primary toxins. Exposure to these aerosolized metals has been termed "Metal Fume Fever", owing to the flu-like symptoms manifest among individuals having experienced repeated and/or prolonged exposure.

At least one pathway for the exposure of the propellant gasses to the warfighter is the open breech of the firearm. The breech is immediately adjacent to or at least in close proximity with the warfighter's face, nose and mouth. Moreover, the breech is opened after each and every round fired. These weapons achieve rates of fire in a range of up to approximately 750 rounds per minute. As firearms and ammunition are developed to higher stopping power and/or muzzle velocities, the quantity, temperature, pressure and toxicity of the propellant gasses 18 only increases.

Moreover, at least one second-order effect of the increase in firearm capability is the resultant desire and/or requirement for sound and/or flash suppression at the muzzle of the firearm. A sound and/or flash suppressor operates by trapping at least part of the escaping propellant gasses 18 as they exit at the muzzle 36. This necessarily creates a region of elevated pressure at the muzzle 36. Accordingly, when the breach of the weapon opens to cycle the expended cartridge and load a new one, exposing the breech end of the weapon to atmospheric pressure, a pressure differential is created across the firing chamber 32 and through barrel 14. This pressure differential tends to push propellant gasses 18 out of the open breach and towards the warfighter.

Therefore, there is a need in the art of armaments for a weapon that limits the exposure of the warfighter to toxic propellant gasses.

BRIEF SUMMARY OF THE DISCLOSURE

In order to overcome these and other short comings in the known art, provided according to the present disclosure is an operating rod apparatus for a reloading firearm. The operating rod apparatus is translatable from a first forward position corresponding with a closed and locked condition of the firearm breech bolt, to a second rearward position corresponding with an open condition of the firearm breech bolt. The disclosed operating rod apparatus comprises a forward operating rod stem, operatively connected at a first forward end thereof to a piston for driving the operating rod apparatus. The forward operating rod stem has a second end substantially opposite the first end, and a cam associated with the second end of the rod stem. A cylinder has a passage that is in fluid communication with a pressure port located along a barrel of the firearm, between a first muzzle end and a second firing chamber end. The fluid communication is operative to admit propellant gasses of the firearm into the cylinder forward of the piston.

An operating tube, having a first end and a second end substantially opposite the first end, is in sliding engagement with the second end of the forward operating rod. The second end of the operating tube is operatively connected to a bolt carrier mechanism of the reloading firearm. A rod sear is movable between a first position that constrains movement of the operating tube, and a second position that frees the operating tube to translate. An elastic bias urges the rod sear into its first position, and is overcome by the action of the cam associated with the second end of the rod stem. The cam displaces the rod sear into its second position. A return spring biases the operating rod apparatus towards its first forward position.

In a further particularized embodiment of the operating rod apparatus, the operating tube has a tube wall with one or more substantially longitudinal slots formed therein. In such embodiments, at least a portion of the cam associated with the second end of the rod stem is received in the one or more substantially longitudinal slots. The cam is guided by the one or more substantially longitudinal slots as the rod stem slidably engages with the operating tube. Optionally or additionally, the rod sear has a rod catch that is received in a sear opening of the operating tube as the rod sear is in its first position. The rod catch restrains the operating tube in its forwardmost position. The rod sear may have a cam follower that extends into the one or more substantially longitudinal slots. The cam acts on the cam follower to move the rod sear into its second position at a predetermined position of longitudinal displacement of the cam.

In a further particularized embodiment of the operating rod apparatus, an elastic spring is positioned and operable to bias the rod stem away from the operating rod tube towards a first forward position of the operating rod apparatus. Optionally, the elastic spring is received within the operating rod stem. In a more particularized embodiment, the elastic spring is a helical coil elastic spring having opposed first and second ends, and further includes at least one end plate, such end plate connected with either the first or the second end of the helical coil elastic spring and being perpendicular to a longitudinal axis of the helical coil elastic spring. In such an embodiment, a guide rod extends forward from the rearward position of the operating rod apparatus, and substantially coaxial with a longitudinal axis of the operating tube. The return spring comprises a helical coil spring mounted around and supported by the guide rod. An axial passage exists at least partially the operating rod apparatus having clearance to admit the guide rod. The second rearward position of the operating rod apparatus is defined by the second end of the forward operating stem contacting a forward first end of the guide rod.

Further provided according to the present disclosure is an operating rod apparatus for a reloading firearm in which the operating rod apparatus is translatable from a first forward position corresponding with a closed and locked condition of the firearm breech bolt, to a second rearward position corresponding with an open condition of the firearm breech bolt. A forward operating rod stem is operatively connected at a first forward end thereof to a piston for driving the operating rod apparatus, the forward operating rod stem having a substantially opposite second end thereof. A cam is associated with the second end of the rod stem. A cylinder has a passage that is in fluid communication with a pressure port located along a barrel of the firearm, between a first muzzle end and a second firing chamber end. The fluid communication is operative to admit propellant gasses of the firearm into the cylinder forward of the piston.

An operating tube has a first end and a substantially opposite second end is in sliding engagement with the second end of the forward operating rod. The second end of the operating tube is operatively connected to a bolt carrier mechanism of the reloading firearm. A helical coil spring is received within the operating rod tube, positioned and operable to bias the rod stem away from the operating rod tube towards a first forward position of the operating rod apparatus. A rod sear is movable between a first position that constrains movement of the operating tube, and a second position that frees the operating tube to translate. An elastic bias urges the rod sear into its first position, and is overcome by the action of the cam associated with the second end of the rod stem, displacing the rod sear into its second position. A return spring biases the operating rod apparatus towards its first forward position.

In a further particularized embodiment of the operating rod apparatus, the operating tube has a tube wall with one or more substantially longitudinal slots formed therein. At least a portion of the cam is received in the one or more substantially longitudinal slots, and the cam is guided by the one or more substantially longitudinal slots as the rod stem slidably engages with the operating tube. Optionally or additionally the rod sear has a rod catch that is received in a sear opening of the operating tube as the rod sear is in its first position. The rod catch restrains the operating tube in its forwardmost position. The rod sear has a cam follower that extends into the one or more substantially longitudinal slots. The cam acts on the cam follower to move the rod sear into its second position at a predetermined position of longitudinal displacement of the cam within the one or more substantially longitudinal slots. In a more particular embodiment, the helical coil spring has opposed first and second ends, and further includes at least one end plate, said at least one end plate perpendicular to a longitudinal axis of the helical coil elastic spring connected with either the first or the second end of the helical coil elastic spring.

Optionally or additionally, a guide rod extends forward from the rearward position of the operating rod apparatus, substantially coaxial with a longitudinal axis of the operating tube. The return spring includes a helical coil spring mounted around and supported by the guide rod. The operating rod apparatus can have an axial passage at least partially therethrough having clearance to admit the guide rod. The second rearward position of the operating rod apparatus is defined by the forward operating stem contacting a forward first end of the guide rod.

Further provided according to the present disclosure is an operating rod apparatus for a reloading firearm in which the operating rod apparatus is translatable from a first forward position corresponding with a closed and locked condition of the firearm breech bolt, to a second rearward position corresponding with an open position of the firearm breech bolt. The operating rod apparatus has a forward operating rod stem operatively connected at a first forward end thereof to a piston for driving the operating rod apparatus. The forward operating rod stem has a second end substantially opposite said first end, with a cam associated with the second end of the rod stem. A cylinder having a passage that is in fluid communication with a pressure port located along a barrel of the firearm between the muzzle end and the firing chamber end. The fluid communication is operative to admit propellant gasses of the firearm into the cylinder forward of the piston.

An operating tube having a first end and a substantially opposite second end is in sliding engagement with the second end of the forward operating rod. A second end of the operating tube being substantially opposite the first end is operatively connected to a bolt carrier mechanism of the reloading firearm. A rod sear is movable between a first position that constrains movement of the operating tube, and a second position that frees the operating tube to translate. An elastic bias that urges the rod sear into its first position, and is overcome by the action of the cam. The cam displacing the rod sear into its second position thereof. A return spring biases the operating rod stem towards the first forward position of the operating rod apparatus.

In a more particular embodiment, the return spring acts on the second end of the forward operating stem to bias the operating rod apparatus towards its first forward position. Optionally or additionally, a guide rod extends forward from the rearward position of the operating rod apparatus, substantially coaxial with a longitudinal axis of the operating tube. The return spring includes a helical coil spring mounted around and supported by the guide rod. In a still more particular embodiment, the operating rod apparatus has an axial passage at least partially therethrough having clearance to admit the guide rod. The second rearward position of the operating rod apparatus is defined by the second end of the forward operating stem contacting a forward first end of the guide rod. In a still more particular embodiment, the operating tube has a tube wall with one or more substantially longitudinal slots. At least a portion of the cam associated with the second end of the rod stem is received in the one or more slots. The cam is guided by the one or more slots as the rod stem slidably engages with the operating tube. Optionally or additionally, the rod sear has a rod catch that is received in a sear opening of the operating tube as the rod sear is in its first position. The rod catch restrains the operating tube in its forwardmost position. The rod sear additionally may include a cam follower that extends into the one or more substantially longitudinal slots. The cam acts on the cam follower to move the rod sear into its second position at a predetermined position of longitudinal displacement.

BRIEF DESCRIPTION OF DRAWINGS

These and other features, benefits, and advantages of the present disclosure will be made apparent with reference to the following detailed description, appended claims, and accompanying figures, wherein like reference numerals refer to like structures across the several views, and wherein:

DETAILED DESCRIPTION OF THE DISCLOSURE

Figure 1:
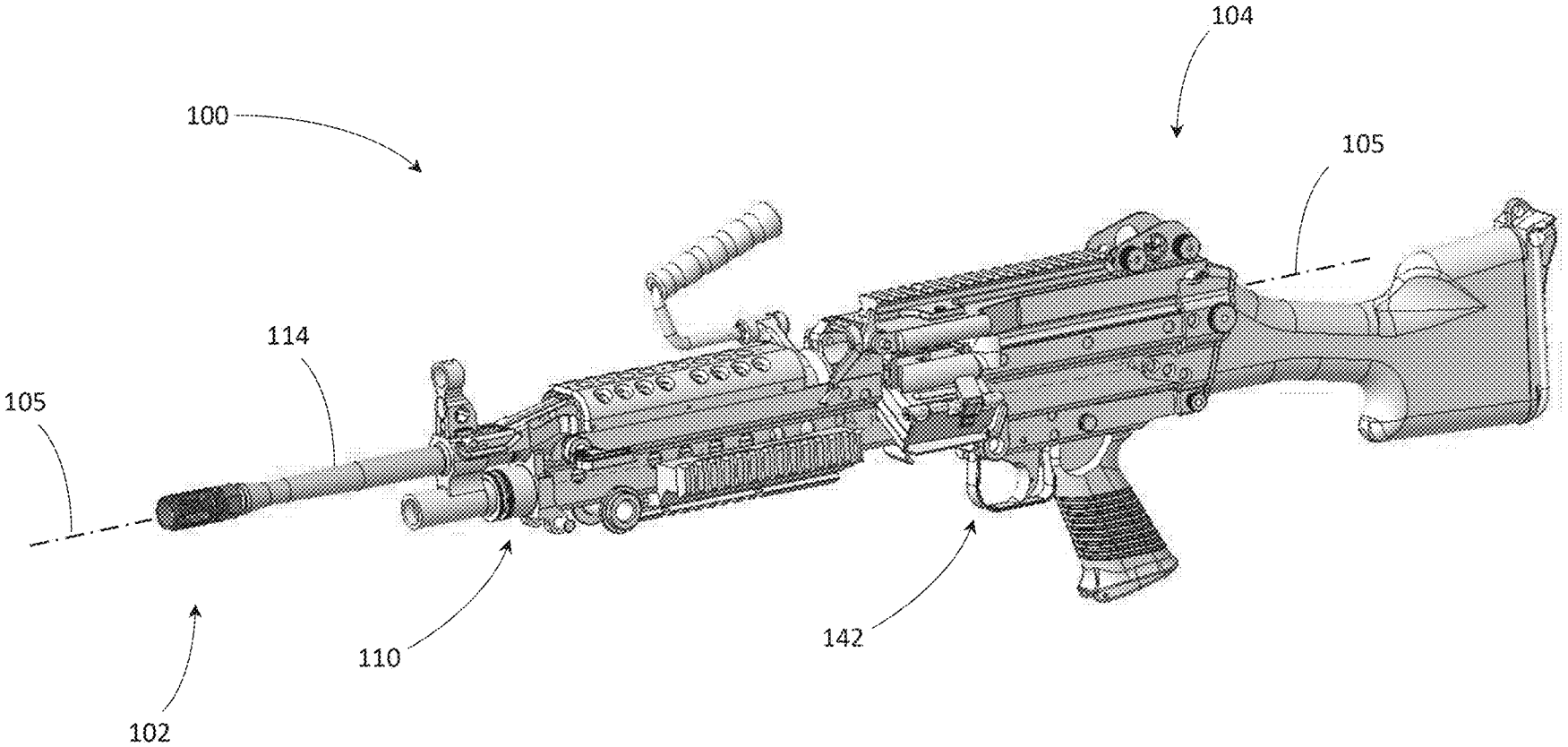
FIG. 1 illustrates a perspective view of an automatically reloading firearm weapon system fitted with a gas-operated piston reloading system.

Referring now to FIG. 1, illustrated in perspective view is an automatically reloading firearm weapon system, generally 100. The weapon system 100 is characterized by its elongated barrel 114. A centerline 105 of the barrel 114 is depicted at the front end 102 and a rear end 104 of the weapon system 100. The weapon system 100 is fitted with a gas-operated piston reloading system, generally 110. In this embodiment, the gas-operated piston reloading system 110 is positioned below the barrel 114. In alternate embodiments, it may alternately or additionally located above the barrel 114, and/or to either or both sides.

Figure 2:
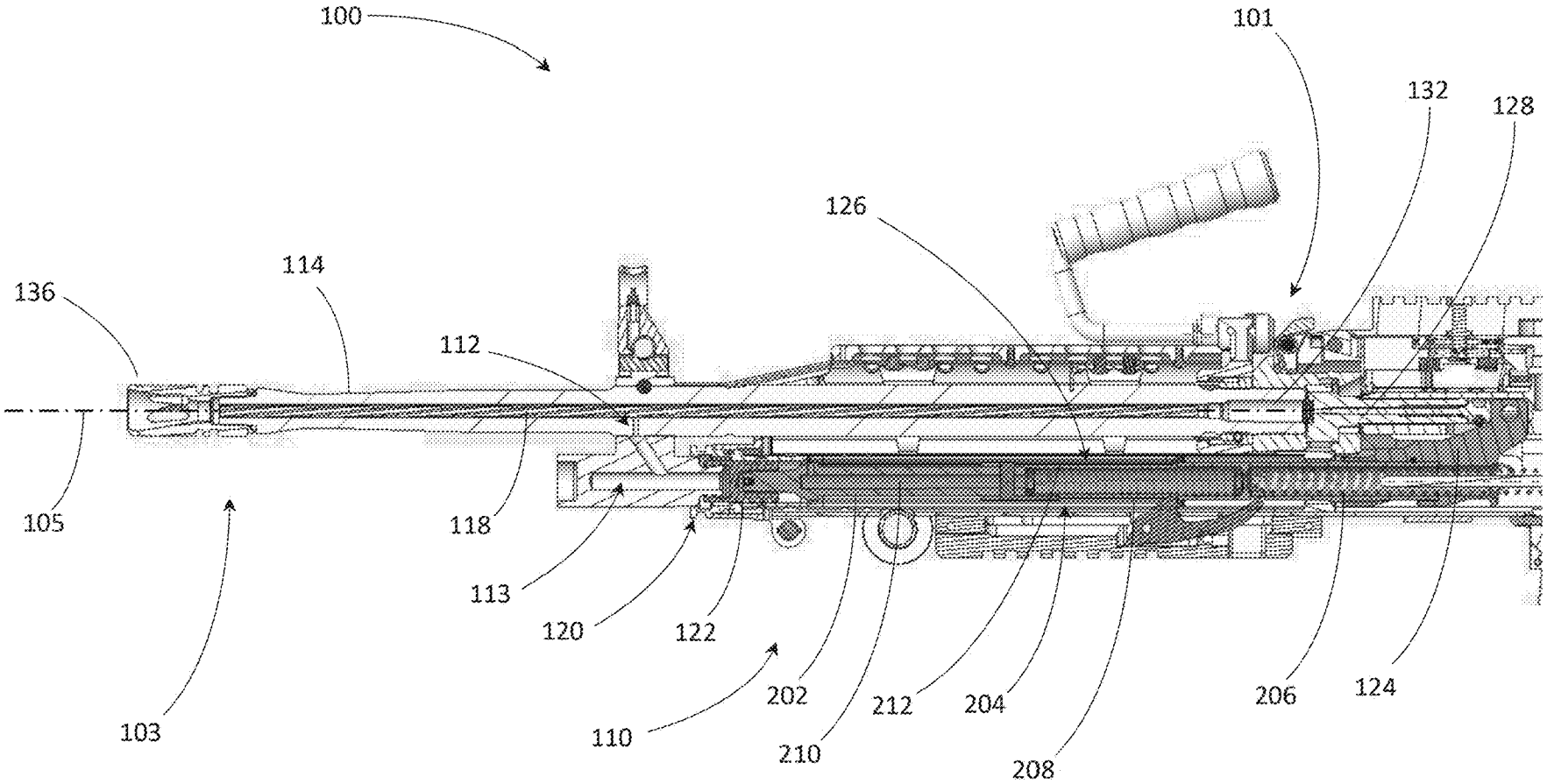
FIG. 2 illustrates a longitudinal cross-section view taken along a centerline of the automatically reloading firearm weapon system including a gas-operated piston reloading system with reduced blowback, consistent with a first embodiment of the instant disclosure.

Referring now to FIG. 2, illustrated is a longitudinal cross-section view, taken generally along centerline 105, of a gas-operated piston reloading system 110 with reduced blowback, consistent with the instant disclosure. The system 110 operates with a gun barrel 114 having a firing chamber 132 at a first end 101 thereof, the first end being generally proximal to the warfighter. The barrel 114 has a second end 103 opposite the first end 101, the second end 103 forming the muzzle 136 of the weapon system 110. A bleed port 112 is located along the length of the barrel 114. A passage 113 leading from the bleed port 112 connects the interior of the barrel 114 with a reloading cylinder 120. A piston 122 is fitted within the cylinder 120 and moves, in this case rearward, when exposed to the pressure of propellant gasses 118 vented from the barrel 114 through the bleed port 112 and passage 113.

Figure 3:
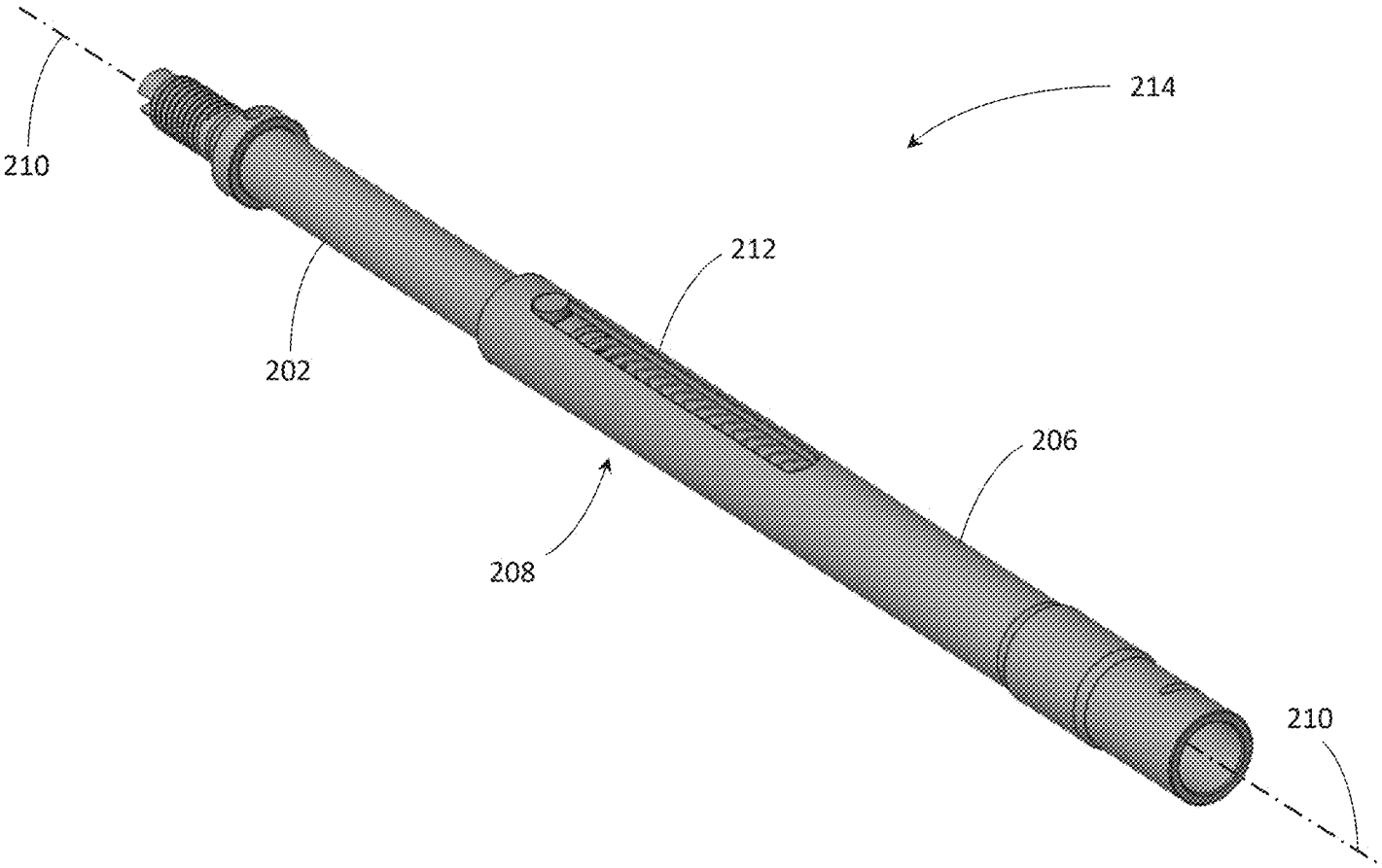
FIG. 3 illustrates a perspective view of an operating rod assembly of the first embodiment.

The piston 122 is attached to a forward operating stem 202 that makes up at least part of the reloading rod 126. The forward operating stem 202 interfaces with a distal end 204 of the operating rod tube 206. The operating rod tube 206 includes at least one cam slot 208 along its length. The cam slot 208 is provided in the wall of the rod tube 206 and extends in a direction of the longitudinal axis 210 of the rod tube 206. More preferably, two cam slots 208 and 212 are provided, and these may be diametrically opposed, as depicted in the longitudinal cross-section of the operating rod assembly 214, depicted in a perspective view as FIG. 3, and in a longitudinal cross section as FIG. 4.

The motion of the forward operating stem 202 is constrained by the cam 216. The cam 216 is secured to the forward operating stem 202. Cam body 218 may be generally cylindrical in shape, and pass-through hole 220 provided transversely in forward operating stem 202. The cam 216 can be secured by a threaded fastener 222. The fastener 222 also holds a bushing 224. Assembled, the bushing 224 follows the cam slot 212 that is opposed from cam slot 208. Cam lobe 226 extends out from the cam body 218, and cam lobe 226 follows the cam slot 208. Cam 216 thus moves generally longitudinally along axis 210 within either or both cam slots 208 and 212.

Figure 4:
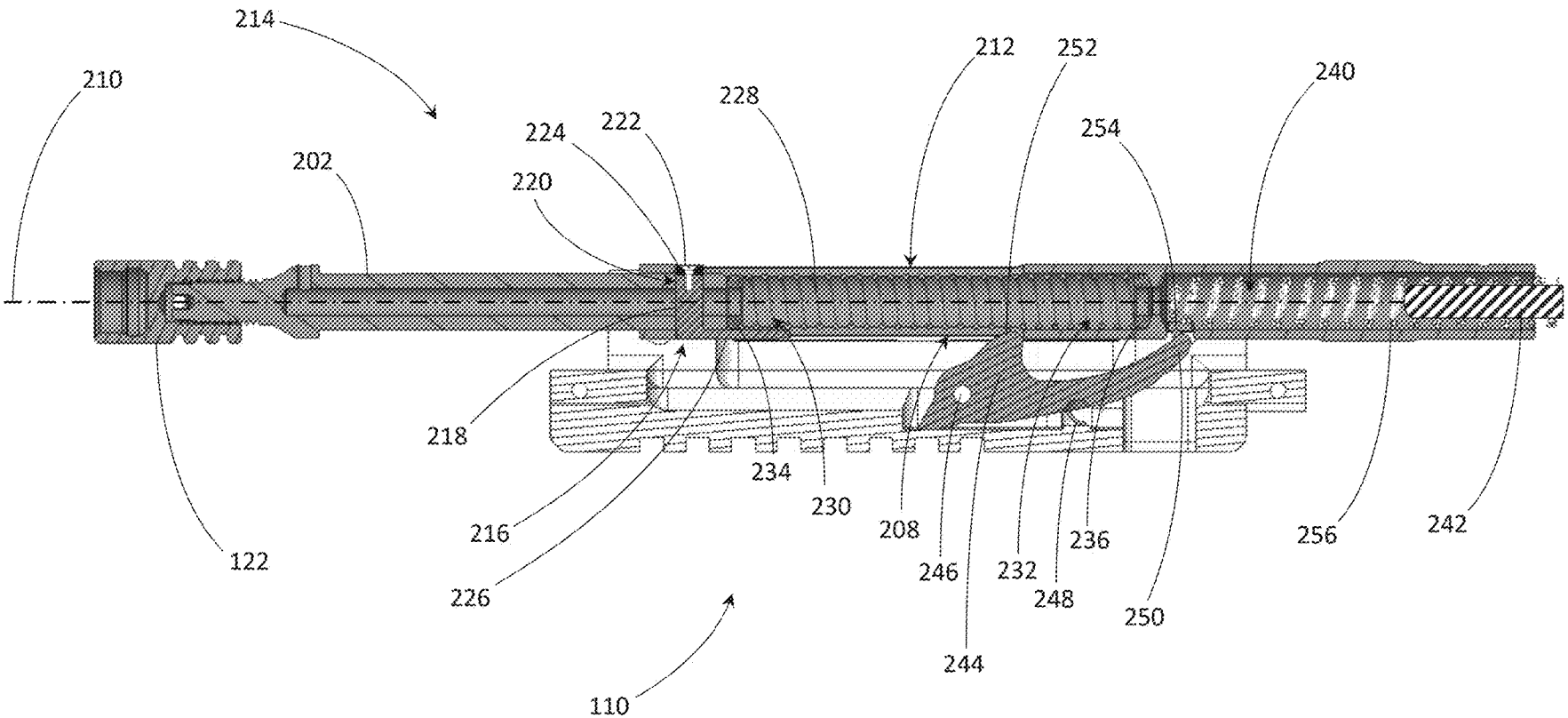
FIG. 4 illustrates a longitudinal cross-section taken along a centerline of the operating rod assembly depicted in FIG. 3, showing detail of the reloading architecture in a forwardmost position thereof.

Referring now to FIG. 4, illustrated is a longitudinal cross section showing detail of the exemplary reloading architecture, generally 200, in a forwardmost position. The forward operating stem 202 is biased in the forward direction by an elastic spring 228. In the depicted embodiment, elastic spring is a helical compression spring formed of coiled metal wire, although other forms of spring 228 may be substituted. In the case of the helical compression elastic spring 228, the first and second ends, 230 and 232 respectively, of the spring 228 are each fitted with first and second end plates, 234 and 236, respectively. The end plates 234, 236 are substantially perpendicular with the longitudinal axis 210, to provide a substantially flat surface to facilitate the helical spring 228 giving and receiving axial forces more accurately parallel with the longitudinal axis 210. Moreover, end plates 234, 236 are preferably toroidal. Together with elastic spring 228 configured as a helical spring, among other components, an axial passage 240 is provided longitudinally through the center of the operating rod assembly 214. The axial passage 240 serves, at least in part, to admit a guide rod 242, particularly when the operating rod assembly 214 is translated to an aft-most and/or compressed configuration.

Provided adjacent to the operating rod assembly 214, and more particularly along the length of the operating rod tube 206 is a rod sear 244. The rod sear 244 is mounted for movement between an engaged position where the rod sear 244 may engage with the operating rod assembly 214 and/or the operating rod tube 206 thereof, to a disengaged position relative to the operating rod assembly and/or operating rod tube 206. In this embodiment, the rod sear 244 is mounted for rotary movement around a rod sear pin 246. An engagement spring 248 biases the rod sear 244 into engagement with the operating rod assembly 214. The engagement spring 248 is, in this embodiment, a compression spring, particularly a low-profile compression spring. In other embodiments, the rod sear 244 can be biased into engagement with the operating rod assembly 214 and the operating rod tube 206 by a torsion spring associated with the rod sear pin 246. Alternately and/or additionally, the rod sear 244 may translate into and/or out of engagement with the operating rod assembly 214 and/or the operating rod tube 206.

The operating rod sear 244 has a cam follower 252, which, in the position of FIG. 4 wherein the rod sear 244 is engaged with the operating rod assembly 214, the cam follower 252 extends into cam slot 208. In addition, the rod sear 244 has a rod catch 250 extending therefrom. In the engaged position of the rod sear 244, the rod catch extends into an operating rod sear opening 254. In the engaged position of the rod sear 244, the rod catch 250 immobilizes the operating rod tube 206 in a full forward position. Alternately or additionally, in this or other embodiments, the rod sear 244 may immobilize the operating rod assembly 214 and/or operating rod tube 206 by frictional engagement, magnetic engagement and/or electromagnetic engagement at the first position of the rod sear 244.

As the fired projectile 116 proceeds down the barrel 114, it will unmask the bleed port 112 to propellant gasses 118. While the projectile 116 remains within the barrel, propellant gasses 118 fill the cylinder 120, and drive the piston 122, together with the forward operating stem 202 attached to the piston 122, both rearward, acting against the force of the spring 228. The cam 216, constrained by cam slots 208 and/or 212, guides the rearward movement of the operating stem 202.

Figure 5:
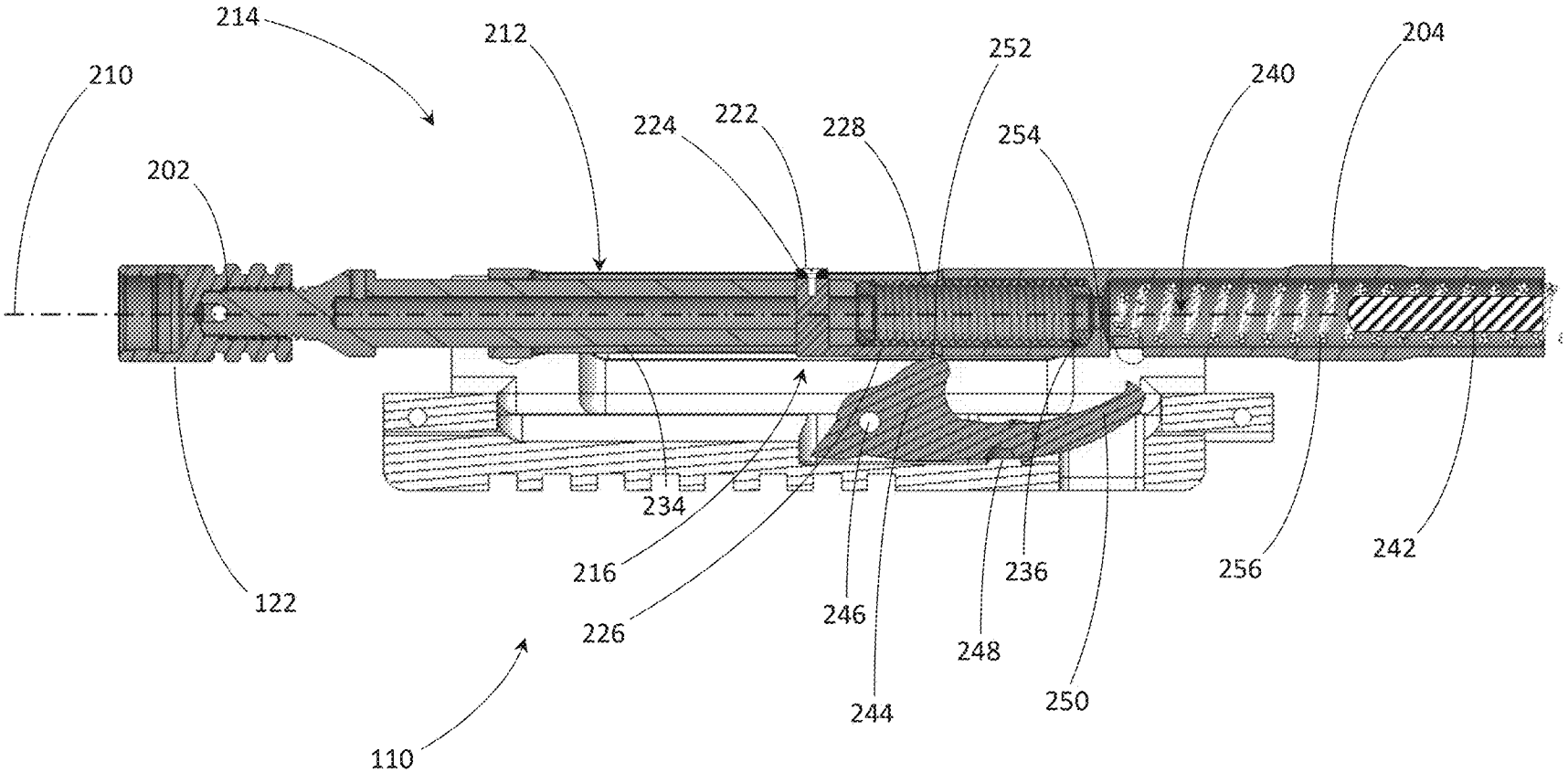
FIG. 5 illustrates a longitudinal cross-section taken along a centerline of the of the operating rod assembly depicted in FIG. 3, showing detail of the reloading architecture of the first embodiment, in which the forward operating stem is displaced rearward as part of the reloading cycle.

Referring now to FIG. 5, as the cam 216 reaches the end of its rearward travel, i.e., the rearward extent of cam slots 208 and/or 212, the cam lobe 226 acts on the cam follower 252 to pivot the rod sear 244 out of engagement with the operating rod 204. In particular, the rod catch 250 is displaced from the sear opening 254, which thereby frees the operating rod 204 to move rearward, together with piston 122 and operating stem 202, under the continued pressure of propellant gasses 118, towards the rearward end of its stroke. The end of stroke may be set according to the length of guide rod 242, in connection with one of more openings comprising the axial passage 240. Guide rod 242 also supports the return spring 256, which is operative to return the operating rod 204 forward from its rearward end of stroke.

The operating rod 204, being operatively connected with the bolt carrier 124, once free to move rearward will act to carry the blot carrier 124 rearward. This has the effect of automatically opening the breech bolt 128 and sliding the breech bolt 128 rearward. Rearward motion of the breech bolt 128 extracts the spent cartridge from the firing chamber 132 and ejects it from the weapon 100. Reaching a rearward end of stroke, the return spring 256 pushes the entire assembly 214 forward to its initial position. In so doing, a fresh cartridge is stripped from the magazine by the bolt 128 and fed into the firing chamber 132. The bolt carrier 124 closes and locks the breech bolt 128.

As the operating rod tube 206 reaches the forward end of its stroke, the rod sear 244, and particularly the rod catches 250, enters the sear opening 254, holding the rod tube 206 in the forward position. The spring 228 drives the rod stem 202 fully forward, and the attached piston 122 fully into cylinder 120. The weapon is thus loaded and ready to fire the next round, repeating the cycle just described.

Figure 6:
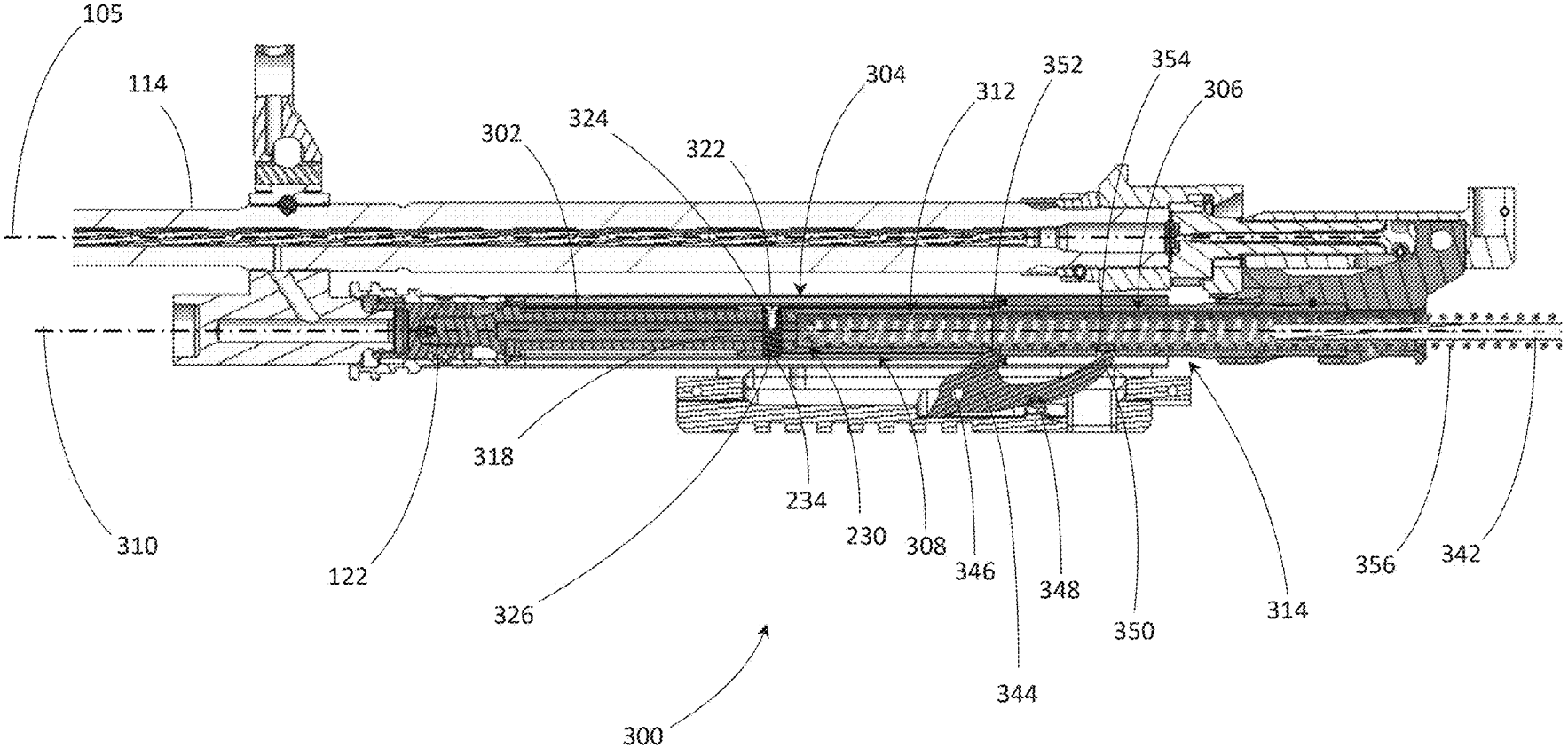
FIG. 6 illustrates a longitudinal cross-section of an alternate embodiment of the reloading architecture according to the instant disclosure.

Referring now to FIG. 6, illustrated in longitudinal cross-section is an alternate embodiment of the reloading architecture, generally 300. In this embodiment, the operating rod assembly 314 includes a forward operating rod stem 302, connected at one end thereof to a piston 122 fitted within a cylinder 120. Propellant gasses 118 driving a projectile 116 through the barrel 114 are admitted into the cylinder 120 via passage 113. The rod stem 302 is biased in the forward direction by the return spring 356, which surrounds and is supported by guide rod 342.

The forward operating stem 302 interfaces with a distal end 304 of the operating rod tube 306. The operating rod tube 306 includes at least one cam slot 308 along its length. The cam slot 308 is provided in the wall of the rod tube 306 and extends in a direction of the longitudinal axis 310 of the rod tube 306. More preferably, two cam slots 308 and 312 are provided, and these may be diametrically opposed, as depicted in the longitudinal cross-section of FIG. 6 taken through the reloading architecture 300, and particularly operating rod assembly 314.

The motion of the forward operating stem 302 is constrained by the cam 316. The cam 316 is secured to the forward operating stem 302. A bushing 324 attached to the cam body 318, e.g., via fastener 322, follows the cam slot 312 opposed from cam slot 308. Cam lobe 326 extends from the cam body 318, and cam lobe 326 follows the cam slot 308. In this embodiment, the cam 316 thus moves generally longitudinally along axis 310 within either or both cam slots 308 and 312.

Provided adjacent to the operating rod assembly 314, and more particularly along the length of the operating rod tube 306 is a rod sear 344. The rod sear 344 is mounted for rotary movement around a rod sear pin 346. By rotating around the rod sear pin 346, the rod sear 344 may engage with or disengage from the operating rod assembly 314 and/or the operating rod tube 306 thereof. An engagement spring 348 biases the rod sear 344 into engagement with the operating rod assembly 314.

The operating rod sear 344 has a cam follower 352, which, in the position of wherein the rod sear 344 is engaged with the operating rod assembly 314, the cam follower 352 extends into cam slot 308. In addition, the rod sear 344 has a rod catch 350 extending therefrom. In the engaged position of the rod sear 344, the rod catch 350 extends into an operating rod sear opening 354. In the engaged position of the rod sear 344, the rod catch 350 immobilizes the operating rod tube 306 in a full forward position.

Figure 7:
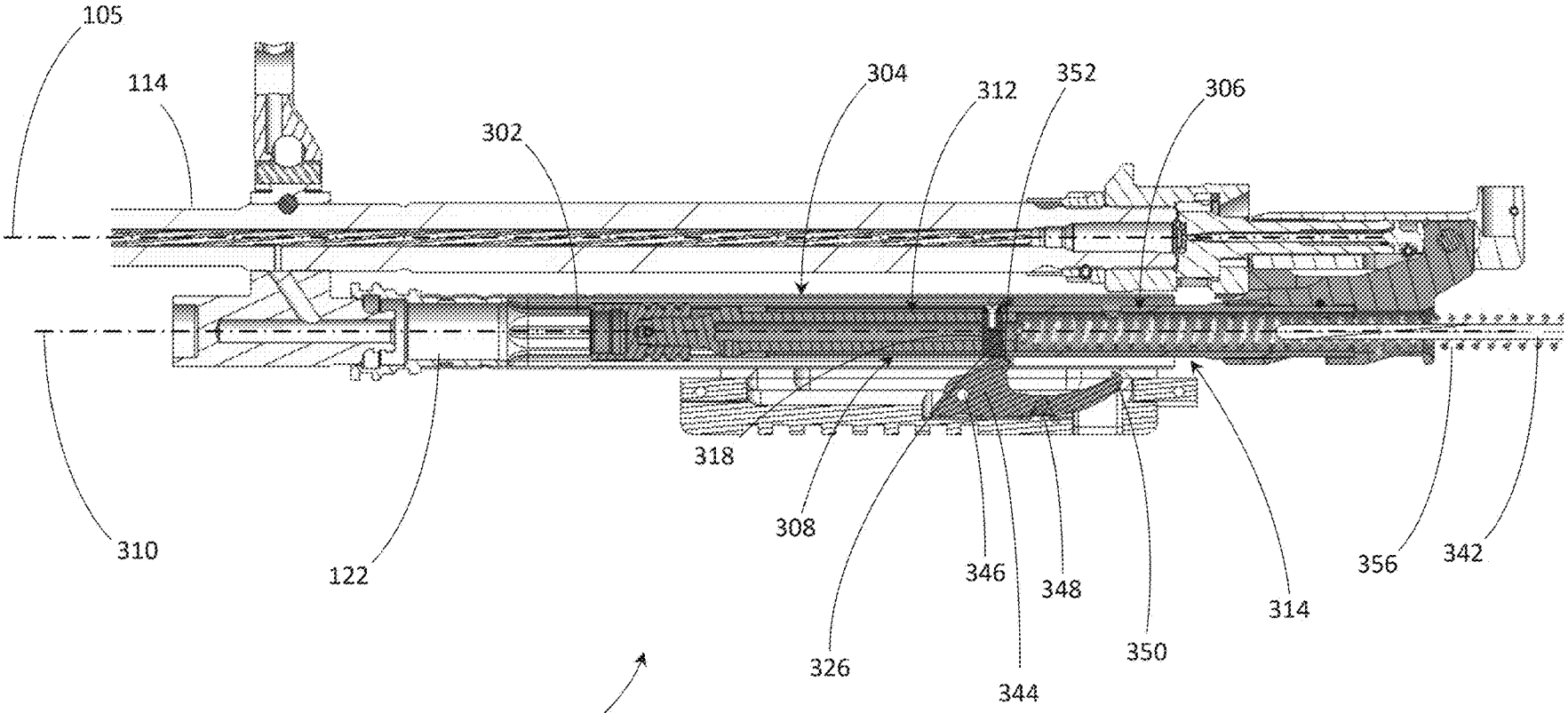
FIG. 7 illustrates the second embodiment shown in FIG. 6, in a position or configuration having the forward operating stem displaced rearward as part of the reloading cycle.
Figure 8A:
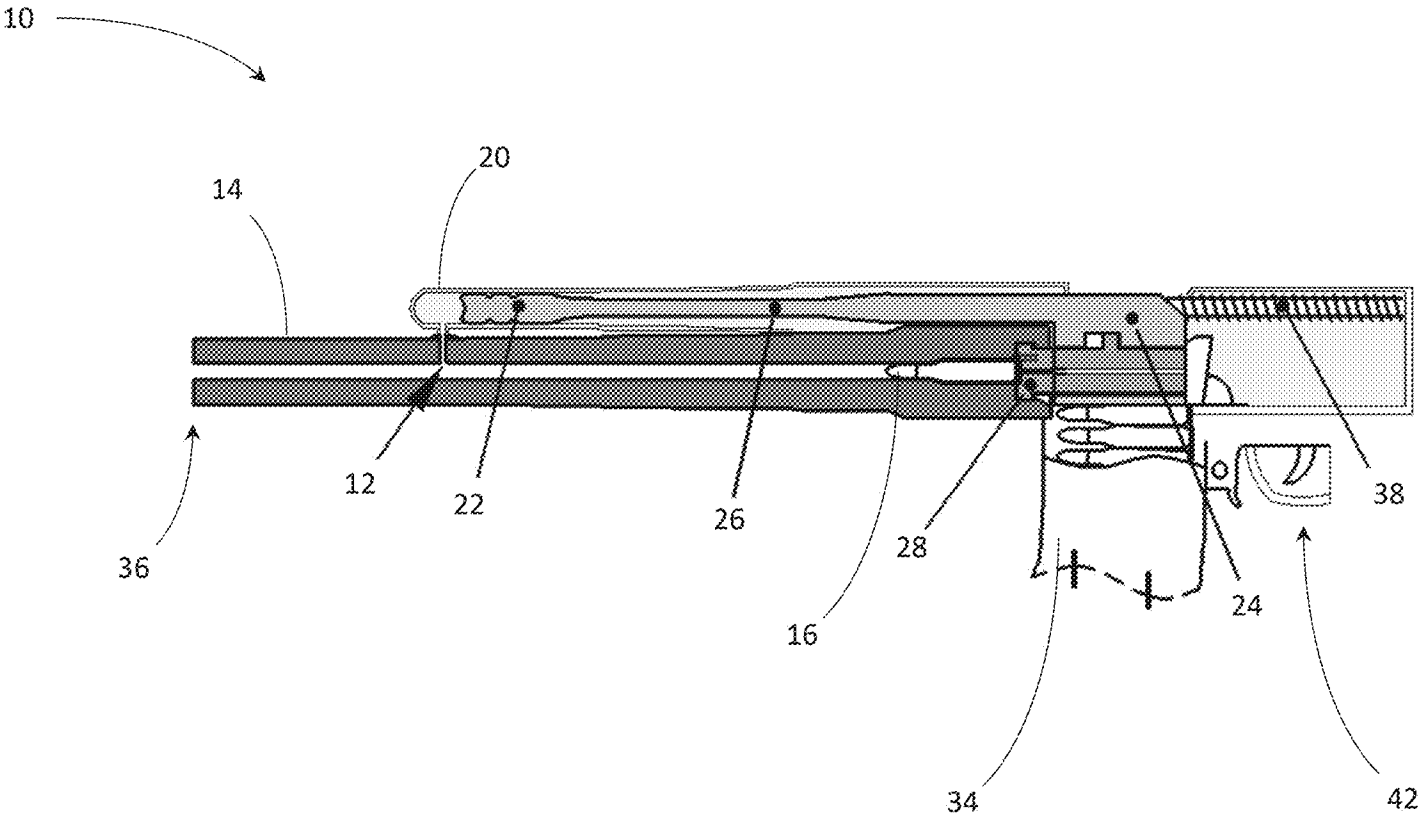
FIG. 8A schematically illustrates a longitudinal cross-section of an operating rod reloading assembly according to the known art, in its forwardmost and/or rest position.
Figure 8B:
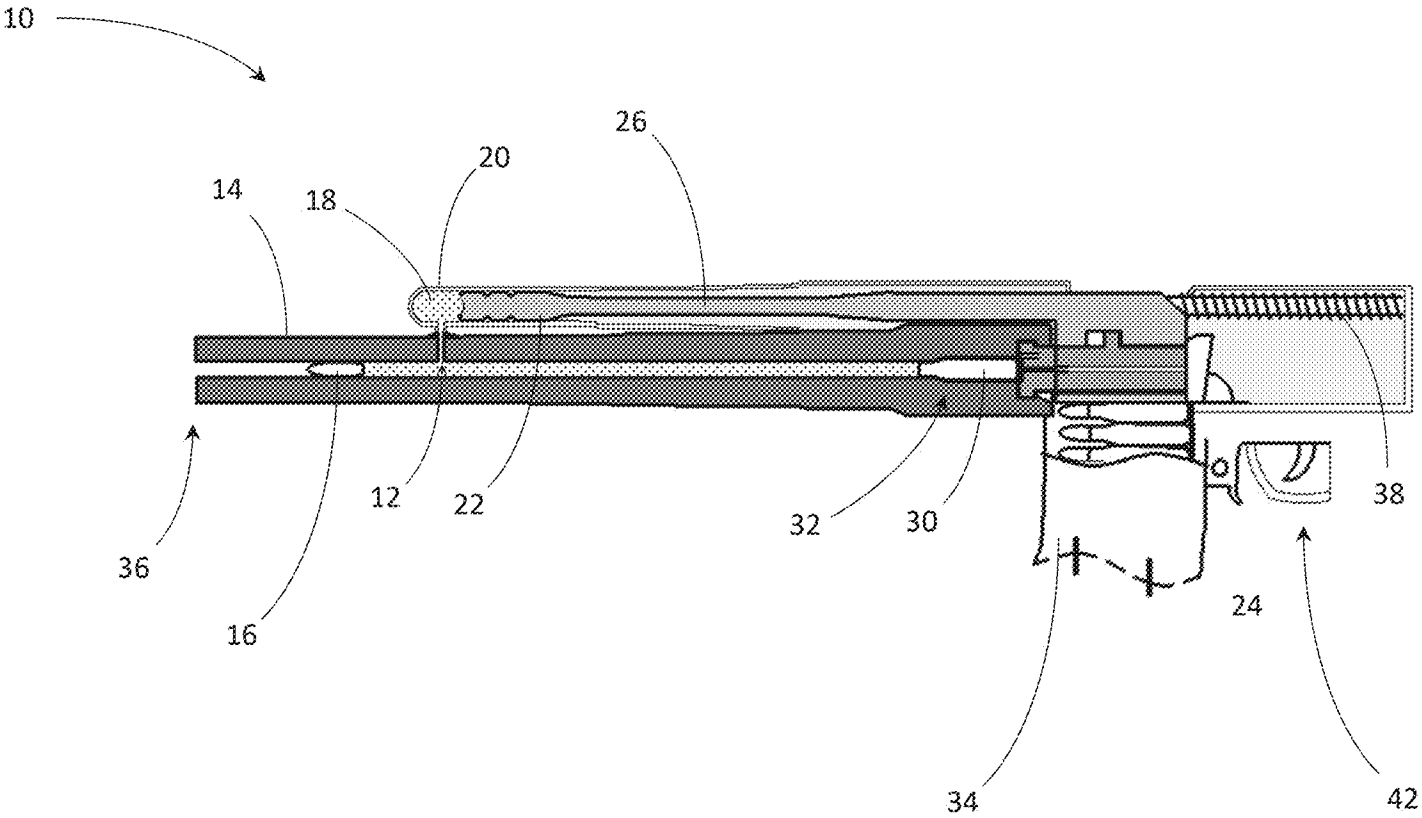
FIG. 8B schematically illustrates the longitudinal cross-section of the prior art operating rod reloading assembly depicted in FIG. 8A, as the reloading cycle is initiated by firing an ammunition cartridge/round.
Figure 8C:
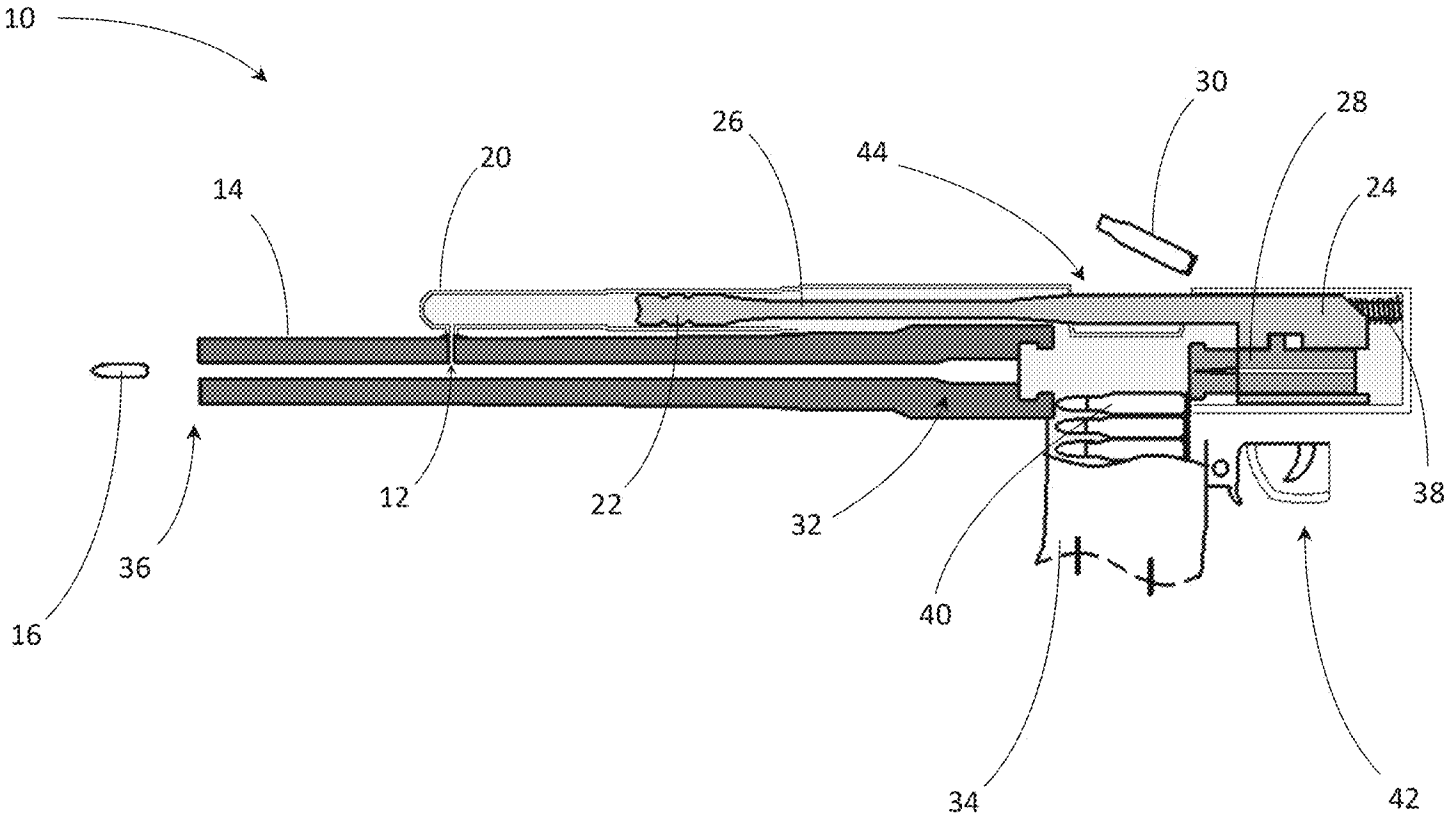
FIG. 8C schematically illustrates the longitudinal cross-section of the prior art operating rod reloading assembly depicted in FIGS. 8A and 8B, as the reloading cycle reaches a rearward-most position of the operating rod.

Referring now to FIG. 7, as propellant gasses 116 fill the cylinder 120 and drive the piston 122 rearward, the cam 316 approaches the end of its rearward travel, i.e., the rearward extent of cam slots 308 and/or 312. The cam lobe 326 acts on the cam follower 352 to pivot the rod sear 344 out of engagement with the operating rod 304. In particular, the rod catch 350 is displaced from the sear opening 354, which thereby frees the operating rod 304 to move rearward, together with piston 122 and operating stem 302, under the continued pressure of propellant gasses, towards the rearward end of its stroke. The end of stroke may be set according to the length of guide rod 342, for example acting bearing upon the end of the rod stem 302, and/or by the length of the operating rod 304. The return spring 356 is operative to return the operating rod 304 forward from its rearward end of stroke. In so doing, the operating rod assembly 314 operates the bolt carrier 124 to cycle the spent cartridge, etc., as in the previously described embodiment.

The return spring 356 acts on the forward rod stem 302, and through the cam 316 reaching the forward end of cam slots 308 and/or 312, the operating rod tube 306 is also returned to its forward position. As the rod assembly 314 reaches the forward end of its stroke, the rod sear 344, and particularly the rod catch 350, enters the sear opening 354, holding the rod tube 306 in the forward position. The return spring 356 drives the rod stem 302 fully forward, and the attached piston 122 fully into cylinder 120. The weapon is thus loaded and ready to fire the next round, repeating the cycle just described.

Comparing the two embodiments of the present disclosure described hereinabove, i.e., a first embodiment as depicted by FIGS. 1-5, and a second embodiment as depicted in part by FIGS. 6-7, reveals certain differences in operation, leading to relative advantages and/or disadvantages. The first embodiment requires 6 new parts as compared with the unmodified weapon. By contrast, the second embodiment requires only 3 additional parts. The first embodiment also requires modification to 6 existing parts of the unmodified weapon. On the other hand, the second embodiment requires modification to 7 existing parts.

The unmodified weapon has a nominal fully automatic firing rate of 750 rounds per minute (rpm). The first embodiment is estimated through simulation to exhibit a rate of fire of approximately 735 rpm. The second embodiment is estimated through simulation to exhibit a rate of fire of approximately 730 rpm. The unmodified weapon had a dwell time, i.e., breech closed time, of approximately 2.0 ms when firing in fully automatic mode. The first embodiment is calculated to increase the dwell time by approximately 1.6 ms to a total of 3.6 ms, an increase of 80%. The second embodiment is calculated to increase dwell time by 2.2 ms, an increase of 110%. Greater dwell time with the firing breech closed corresponds with reduced exposure of propellant gasses to the warfighter. Moreover, increasing the dwell time without otherwise altering the firing cycle has the additional effect of delaying the breech opening after the cartridge is fired. This delay in breech opening permits gas pressure at the muzzle, which may be elevated and/or constrained by flash and/or sound suppression, to dissipate before the breech is opened. Accordingly, when the breech opens later in the firing cycle, there is a reduced pressure gradient across the combination of barrel and firing chamber, which reduces a driving force of propellant gasses towards the warfighter via the open breech.

The present disclosure has been described herein with reference to certain exemplary and/or preferred embodiments. For example, the illustrative weapon platform depicted in FIG. 1, and other figures, will be recognizable by those skilled in the art as based upon the M249 Squad Automatic Weapon. However, it will be readily appreciated by those skilled in the art, having been apprised of the instant disclosure, that the disclosure herein can readily be modified, adapted and/or applied to other weapon platforms, sizes, calibers, etc., without departing from the inventive scope thereof. No limitation as to size, configuration, or caliber is intended, nor shall any be implied. These embodiments are offered as merely illustrative, and not limiting, of the scope of the present disclosure. Certain alterations or modifications may be apparent to those skilled in the art, in light of instant disclosure, without departing from the spirit or scope thereof. The full scope of Applicant's invention is defined solely with reference to the following appended claims.

TABLE OF RECITED ELEMENTS AND REFERENCE NUMERALS

| | |
|---|---|
| 10 | Gas-piston type reloading weapon |
| 12 | Bleed port |
| 14 | Barrel |
| 16 | Projectile |
| 18 | Propellant gasses |
| 20 | Cylinder |
| 22 | Piston |
| 24 | Bolt carrier |
| 26 | Rod |
| 28 | Bolt |
| 30 | Spent cartridge |
| 32 | Firing chamber |
| 34 | Magazine |
| 36 | Muzzle |
| 38 | Return spring |
| 40 | Cartridge |
| 42 | Trigger |
| 44 | Ejection Port |
| 100 | Firearm weapon system |
| 101 | First end of barrel |
| 102 | Front end, weapon system |
| 103 | Second end of barrel |
| 104 | Rear end, weapon system |
| 105 | Centerline, barrel |
| 110 | Gas-Operated Piston Reloading System |
| 112 | Bleed port |
| 113 | Passage |
| 114 | Barrel |
| 116 | Projectile |
| 118 | Propellant gasses |
| 120 | Cylinder |
| 122 | Piston |

-continued

| | |
|---|---|
| 124 | Bolt carrier |
| 126 | Rod |
| 128 | Breech Bolt |
| 132 | Firing chamber |
| 136 | Muzzle |
| 142 | Trigger |
| 144 | Ejection Port |
| 200 | Reloading architecture |
| 202 | Forward operating stem |
| 204 | Distal end, rod tube |
| 206 | Rod tube |
| 208 | Cam slot |
| 210 | Longitudinal axis, rod tube |
| 212 | Cam slot |
| 214 | Operating rod assembly |
| 216 | Cam |
| 218 | Cam body |
| 220 | Hole |
| 222 | Threaded fastener |
| 224 | Bushing |
| 226 | Cam lobe |
| 228 | Elastic spring |
| 230 | First end, spring |
| 232 | Second end, spring |
| 234 | First end plate |
| 236 | Second end plate |
| 240 | Axial passage |
| 242 | Guide rod |
| 244 | Rod sear |
| 246 | Rod sear pin |
| 248 | Engagement spring |
| 250 | Rod catch |
| 252 | Cam follower, rod sear |
| 254 | Sear opening, operating rod |
| 256 | Return spring |
| 300 | Reloading architecture |
| 302 | Operating rod stem |
| 304 | Distal end, operating rod tube |
| 306 | Operating rod tube |
| 308 | Cam slot |
| 310 | Longitudinal axis |
| 312 | Cam slot |
| 314 | Operating rod assembly |
| 316 | Cam |
| 318 | Cam body |
| 324 | Bushing |
| 326 | Cam lobe |
| 342 | Guide rod |
| 344 | Rod Sear |
| 346 | Rod sear pin |
| 348 | Engagement spring |
| 350 | Rod catch |
| 352 | Cam follower |
| 354 | Sear opening, operating rod |
| 356 | Return spring |

The invention claimed is:

1. An operating rod apparatus for a reloading firearm, the operating rod apparatus being translatable from a first forward position corresponding with a closed and locked condition of the firearm breech bolt, to a second rearward position corresponding with an open condition of the firearm breech bolt, the operating rod apparatus comprising:

a rod stem, the rod stem being operatively connected at a first forward end thereof to a piston for driving the operating rod apparatus, the rod stem having a second end thereof substantially opposite said first end;

a cam associated with the second end of the rod stem;

a cylinder having a passage that is in fluid communication with a pressure port located along a barrel of the firearm between a first muzzle end thereof, and a second firing chamber end thereof, the fluid communication being operative to admit propellant gasses of the firearm into the cylinder forward of the piston;

an operating tube that is in sliding engagement with the rod stem, the operating tube having a forward first end and a second end substantially opposite the first end, the second end of the operating tube being operatively connected to a bolt carrier mechanism of the reloading firearm;

a rod sear that is movable between a first position that constrains movement of the operating tube, and a second position that frees the operating tube to translate;

an elastic bias that urges the rod sear into the first position thereof, and is overcome by the action of the cam associated with the second end of the rod stem, said cam displacing the rod sear into the second position thereof; and a return spring biasing the operating rod apparatus towards the first forward position thereof.

2. The operating rod apparatus according to claim 1, further comprising:

the operating tube comprising a tube wall, the tube wall having one or more substantially longitudinal slots formed therein, wherein at least a portion of the cam associated with the second end of the rod stem is received in the one or more substantially longitudinal slots, and the cam is guided by said one or more substantially longitudinal slots as the rod stem slidably engages with the operating tube.

3. The operating rod apparatus according to claim 2, further comprising:

the rod sear having a rod catch that is received in a sear opening of the operating tube as the rod sear is in the first position thereof, the rod catch restraining the operating tube in its forwardmost position; and the rod sear further having a cam follower that extends into the one or more substantially longitudinal slots, wherein the cam acts on the cam follower to move the rod sear into the second position thereof at a predetermined position of longitudinal displacement of the cam.

4. The operating rod apparatus according to claim 1, further comprising:

an elastic spring positioned and operable to bias the rod stem away from the operating rod tube towards a first forward position of the operating rod apparatus.

5. The operating rod apparatus according to claim 4, wherein the elastic spring is received within the operating tube.

6. The operating rod apparatus according to claim 5, wherein the elastic spring is a helical coil elastic spring having opposed first and second ends, and further includes at least one end plate, said at least one end plate connected with either the first or the second end of the helical coil elastic spring, the at least one end plate being perpendicular to a longitudinal axis of the helical coil elastic spring.

7. The operating rod apparatus according to claim 6, further comprising a guide rod extending forward from the rearward position of the operating rod apparatus, and substantially coaxial with a longitudinal axis of the operating tube;

the return spring comprising a helical coil spring mounted around and supported by the guide rod;

the operating rod apparatus having an axial passage at least partially therethrough having clearance to admit the guide rod, wherein the second rearward position of the operating rod apparatus is defined by the second end of the rod stem contacting a forward first end of the guide rod.

8. An operating rod apparatus for a reloading firearm, the operating rod apparatus being translatable from a first forward position corresponding with a closed and locked condition of the firearm breech bolt, to a second rearward position corresponding with an open condition of the firearm breech bolt, the operating rod apparatus comprising:

a rod stem, the rod stem being operatively connected at a first forward end thereof to a piston for driving the operating rod apparatus, the rod stem having a second end thereof substantially opposite said first end;

a cam associated with the second end of the rod stem;

a cylinder having a passage that is in fluid communication with a pressure port located along a barrel of the firearm between a first muzzle end thereof, and a second firing chamber end thereof, the fluid communication being operative to admit propellant gasses of the firearm into the cylinder forward of the piston;

an operating tube having a forward first end that is in sliding engagement with the second end of the rod stem, a second end of the operating tube being substantially opposite the first end, the second end of the operating tube being operatively connected to a bolt carrier mechanism of the reloading firearm;

a helical coil spring received within the operating rod tube, positioned and operable to bias the rod stem away from the operating rod tube towards a first forward position of the operating rod apparatus;

a rod sear that is movable between a first position that constrains movement of the operating tube, and a second position that frees the operating tube to translate;

an elastic bias that urges the rod sear into the first position thereof, and is overcome by the action of the cam associated with the second end of the rod stem, said cam displacing the rod sear into the second position thereof; and a return spring biasing the operating rod apparatus towards the first forward position thereof.

9. The operating rod apparatus according to claim 8, further comprising:

the operating tube comprising a tube wall, the tube wall having one or more substantially longitudinal slots formed therein, wherein at least a portion of the cam associated with the second end of the rod stem is received in the one or more substantially longitudinal slots, and the cam is guided by said one or more substantially longitudinal slots as the rod stem slidably engages with the operating tube.

10. The operating rod apparatus according to claim 9, further comprising:

the rod sear having a rod catch that is received in a sear opening of the operating tube as the rod sear is in first position thereof, the rod catch restraining the operating tube in its forwardmost position; and the rod sear further having a cam follower that extends into the one or more substantially longitudinal slots, wherein the cam acts on the cam follower to move the rod sear into the second position thereof at a predetermined position of longitudinal displacement of the cam.

11. The operating rod apparatus according to claim 8, wherein the helical coil spring has opposed first and second ends, and further includes at least one end plate, said at least one end plate connected with either the first or the second end of the helical coil elastic spring, the at least one end plate being perpendicular to a longitudinal axis of the helical coil elastic spring.

12. The operating rod apparatus according to claim 11, further comprising a guide rod extending forward from the rearward position of the operating rod apparatus, and substantially coaxial with a longitudinal axis of the operating tube;

the return spring comprising a helical coil spring mounted around and supported by the guide rod;

the operating rod apparatus having an axial passage at least partially therethrough having clearance to admit the guide rod, wherein the second rearward position of the operating rod apparatus is defined by the rod stem impacting a forward first end of the guide rod.

13. An operating rod apparatus for a reloading firearm, the operating rod apparatus being translatable from a first forward position corresponding with a closed and locked condition of the firearm breech bolt, to a second rearward position corresponding with an open position of the firearm breech bolt, the operating rod apparatus comprising:

a rod stem, the rod stem being operatively connected at a first forward end thereof to a piston for driving the operating rod apparatus, the rod stem having a second end thereof substantially opposite said first end;

a cam associated with the second end of the rod stem;

a cylinder having a passage that is in fluid communication with a pressure port located along a barrel of the firearm between a first muzzle end thereof, and a second firing chamber end thereof, the fluid communication being operative to admit propellant gasses of the firearm into the cylinder forward of the piston;

an operating tube having a forward first end that is in sliding engagement with the second end of the rod stem, a second end of the operating tube being substantially opposite the first end, the second end of the operating tube being operatively connected to a bolt carrier mechanism of the reloading firearm;

a rod sear that is movable between a first position that constrains movement of the operating tube, and a second position that frees the operating tube to translate;

an elastic bias that urges the rod sear into the first position thereof, and is overcome by the action of the cam associated with the second end of the rod stem, said cam displacing the rod sear into the second position thereof; and a return spring biasing the rod stem towards the first forward position of the operating rod apparatus.

14. The operating rod apparatus according to claim 13, the return spring acts on the second end of the rod stem to bias the operating rod apparatus towards the first forward position thereof.

15. The operating rod apparatus according to claim 13, further comprising a guide rod extending forward from the rearward position of the operating rod apparatus, and substantially coaxial with a longitudinal axis of the operating tube, the return spring comprising a helical coil spring mounted around and supported by the guide rod.

16. The operating rod apparatus according to claim 14, further comprising the operating rod apparatus having an axial passage at least partially therethrough having clearance to admit the guide rod, wherein the second rearward position of the operating rod apparatus is defined by the second end of the rod stem impacting a forward first end of the guide rod.

17. The operating rod apparatus according to claim 13, further comprising:

the operating tube comprising a tube wall, the tube wall having one or more substantially longitudinal slots formed therein, wherein at least a portion of the cam associated with the second end of the rod stem is received in the one or more substantially longitudinal slots, and the cam is guided by said one or more substantially longitudinal slots as the rod stem slidably engages with the operating tube.

18. The operating rod apparatus according to claim 17, further comprising:

the rod sear having a rod catch that is received in a sear opening of the operating tube as the rod sear is in first position thereof, the rod catch restraining the operating tube in its forwardmost position; and the rod sear further having a cam follower that extends into the one or more substantially longitudinal slots, wherein the cam acts on the cam follower to move the rod sear into the second position thereof at a predetermined position of longitudinal displacement of the cam.

* * * * *